United States Patent [19]

Berich et al.

[11] 4,067,306

[45] Jan. 10, 1978

[54] SOLENOID OPERATED DEVICE TO CONTROL CURB IDLE POSITION OF THROTTLE VALVE

[75] Inventors: John J. Berich, St. Louis; John H. Krein, Florissant; Mervin L. Augstin, Florissant; Jesse L. Szwargulski, Florissant, all of Mo.

[73] Assignee: ACF Industries, Incorporated, New York, N.Y.

[21] Appl. No.: 699,448

[22] Filed: June 24, 1976

[51] Int. Cl.[2] ..... F02B 77/00

[52] U.S. Cl. ..... 123/198 D; 123/DIG. 11

[58] Field of Search .... 123/198 D, 198 DB, 198 DC, 123/198 R, DIG. 11, 179 BG, 179 G, 180 E

[56] References Cited

U.S. PATENT DOCUMENTS

| | | | |
|---|---|---|---|
| 3,121,214 | 2/1964 | Frederich | 123/198 DC X |
| 3,487,183 | 12/1969 | Schulman | 123/198 DC X |
| 3,730,153 | 5/1973 | Harrison et al. | 123/DIG. 11 X |
| 3,736,915 | 6/1973 | Dickensheets et al. | 123/198 DC |
| 3,760,785 | 9/1973 | Harrison et al. | 123/DIG. 11 X |
| 3,802,406 | 4/1974 | Mennesson | 123/198 DB |
| 3,847,131 | 11/1974 | Hisatomi | 123/198 DB |

*Primary Examiner*—Carroll B. Dority, Jr.

*Assistant Examiner*—Ian S. Lazarus

[57] ABSTRACT

A solenoid actuated device to permit a carburetor throttle valve to close below the curb idle position upon deactivation of an ignition system for an internal combustion engine and to prevent electrical grounding by the device when it is out of contact with the throttle arm. The solenoid actuated device has an armature mounted in a housing for movement between energized and deenergized positions and a shaft extending through the housing is mounted within the bore of the armature for movement therewith. The shaft is in contact with the throttle arm adjacent one end and an electrical lead extends from the other end of the shaft. An insulating sleeve is positioned between the shaft and armature to prevent electrical grounding of the shaft when the shaft is out of electrical contact with the throttle arm. The insulating sleeve and shaft therein may be adjusted longitudinally relative to the armature to control the position of the throttle arm. The lead wire from the shaft extends to a source of electrical energy and upon grounding of the shaft when in contact with the throttle arm, electrical energy may be supplied to other selected electrically actuated devices, such as a means to retard the spark for a distributor.

9 Claims, 6 Drawing Figures

SOLENOID OPERATED DEVICE TO CONTROL CURB IDLE POSITION OF THROTTLE VALVE

BACKGROUND OF THE INVENTION

Heretofore, a solenoid operated device has been provided to control the rate of throttle closure and to prevent after run or "dieseling" of internal combustion engines. Such devices have included a central shaft mounted within the bore of an armature and moveable therewith between energized and deenergized positions with the shaft engaging a throttle arm and upon engine cut-off being moved away from the throttle arm to permit the throttle arm to close the throttle valve below the curb idle position upon deactivation of the ignition system. However, the shaft was not insulated in any manner from the armature or from the housing containing the electrical winding and therefore, was usually grounded. The solenoid operated device has been employed heretofore in combination with a carburetor and has permitted the throttle valve to close at a setting below its curb idle setting upon deenergizing of the ignition system for the internal combustion engine and has been adjustable to vary the position of the throttle arm.

When the ignition system is deenergized at a high rpm curb idle speed, the internal combustion engine has a tendency to continue to draw air and fuel through the carburetor so the engine exhibits what is commonly known as after run or "dieseling" in that the engine continues to operate in a manner similar to a diesel engine. The use of the solenoid operated device permits the throttle valve to be closed below the curb idle position and this prevents the reoccurrence of the dieseling or after run condition. An example of a solenoid actuated device to prevent after run of an internal combustion engine is illustrated in copending application Ser. No. 611,823 filed Sept. 9, 1975, now U.S. Pat. No. 3,971,356, and entitled "Solenoid - Dashpot", assigned to the present assignee.

DESCRIPTION OF THE PRESENT INVENTION

It is desirable for certain conditions of engine operation to have a signal or some other device energized when the shaft of a solenoid actuated device is in contact with the throttle arm and to have the signal or device deenergized when the shaft is out of contact with the throttle arm, such as occurs during acceleration from curb idle. This may be accomplished by having the shaft which permits closing of the throttle valve below curb idle position upon deactivation of the engine connected to a source of electrical energy and grounded by contact with the throttle arm of the carburetor. It is not desirable to have a separate member provide a ground since what is desired to be sensed is contact between the shaft and throttle arm. Thus, it is highly desirable to have the shaft form a double function by having the shaft also act as a ground upon contact with the throttle arm to permit the energizing of other electrical actuated devices fo various purposes.

The present invention is directed to a solenoid actuated device having an outer housing with a core winding therein and an armature mounted for movement between energized positions and deenergized positions relative to the core. A shaft is mounted within the armature and has one end extending from the housing in contact with the throttle arm of a carburetor when in an idle position and when the engine is deactivated. The shaft moves to a retracted position upon deenergizing of the solenoid when the engine is cut off and this permits the throttle valve to close below the curb idle position thereby to prevent after run of the internal combustion engine.

An insulating sleeve in which the shaft is fixed is positioned between the armature and the shaft and is threaded within the armature for longitudinal adjustment relative to the armature thereby to set the curb idle position for the internal combustion engine by contact of the shaft with the throttle arm. An electrical lead extends from the other end of the shaft to a source of electrical energy and any desired electrically actuated signal or device may be positioned between the source of electrical energy and the solenoid actuated device for energizing upon grounding of the shaft which occurs only when contact is made between the shaft and the throttle arm. The insulating sleeve has a central bore with a large diameter portion adjacent one end thereof and a small diameter portion adjacent the other end connected by an intermediate portion having splines thereon so that a shaft having corresponding mating portions thereon may be inserted within the sleeve and be fixed thereto for movement. Other suitable forms of insulating material may be provided to insulate an electrical lead from the solenoid such as the shaft being formed with an integral wire therein incased within an insulating material.

Thus, the present invention of a solenoid actuated device provides an arrangement to control and initially set the curb idle position of the carburetor and to permit the carburetor to close below the curb idle setting upon deactivation of the ignition system for the engine, in combination with the shaft of the solenoid device secured to the armature and acting as a ground when in contact with the throttle arm to permit energizing of a separate signal or electrically actuated device, such as a device to retard the spark of a distributor.

Figure 1:
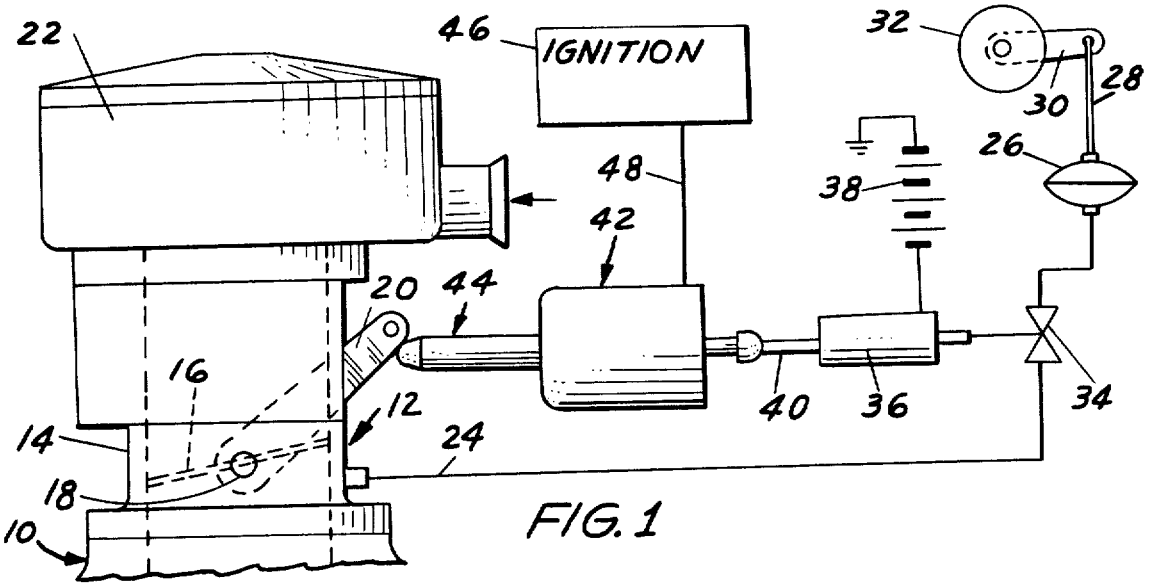
FIG. 1 is a schematic illustrating use of the solenoid actuated device comprising the present invention in an internal combustion engine for retarding the spark of the distributor.

Referring now to a drawing for a better understanding of this invention and more particularly to FIG. 1, an internal combustion engine shown partially at 10 has a carburetor 12 mounted thereon. Carburetor 12 includes an air/fuel mixture conduit 14 having a throttle valve 16 mounted therein. A throttle shaft 18 has a throttle arm or lever 20 secured thereto for rotation with shaft 18. Mounted on the upper end of carburetor 12 is an air horn 22 having a suitabe air cleaner or filter therein as is well-known. A vacuum line 24 extends from air and fuel mixture conduit 14 at a position beneath throttle valve 16 to a vacuum diaphragm valve 26. Vacuum diaphragm valve 26 is connected to a shaft 28 which is pivotally connected to an arm 30 of a distributor 32 for advancing or retarding the spark. To break the vacuum to vacuum diaphragm valve 26, a valve 34 is positioned in vacuum line 24 and when opened will bleed line 24 to atmosphere but when closed will permit the vacuum to be exerted on the diaphragm end of vacuum diaphragm valve 26. A solenoid 36 controls the opening and closing of valve 34 and a source of energy 38 is provided for energizing solenoid 36. When solenoid 36 is energized, valve 34 is moved to an open position to bleed line 24 and when deenergized, valve 34 is in a closed position thereby to permit a vacuum from the intake manifold to be exerted against diaphragm vacuum valve 26.

An electrical lead line 40 extends from solenoid 36 to solenoid actuated device 42 which comprises the present invention. Electrical lead line 40 is connected to an end of a shaft generally indicated at 44 of solenoid actuated device 42. An ignition of internal combustion engine 10 is indicated generally at 46 and an electrical line 48 extends to solenoid actuated device 42 for energizing thereof as will be explained. Shaft 44 has its other end adapted for selected contact with throttle arm 20 when throttle arm in is an idle or cut off position of engine 10 as will be explained further.

Shaft 44 provides a ground for the electrical energy source 38 when in contact with throttle arm 20 and thereby permits energizing of solenoid 36 when shaft 44 is in electrical contact with throttle arm 20 but prevents energizing of solenoid 36 when shaft 44 is out of contact with arm 20.

Solenoid actuated device 42 comprising the present invention has an outer generally cylindrical housing generally indicated at 50 including ends 52 and 54. End 52 has a hub 56 with a central opening 58. End 54 includes an outer hub portion 60 with an opening 62 therein. Mounted within housing 50 is a core 64 having end flanges 66 and 68. A winding 70 is mounted on core 64 between flanges 66 and 68. Lead line 48 from ignition 46 extends through a suitable elastomeric grommet 72 in hub 60 and is connected to a connector 74 on core 64 to energize device 50 upon activating ignition 46.

Figure 2:
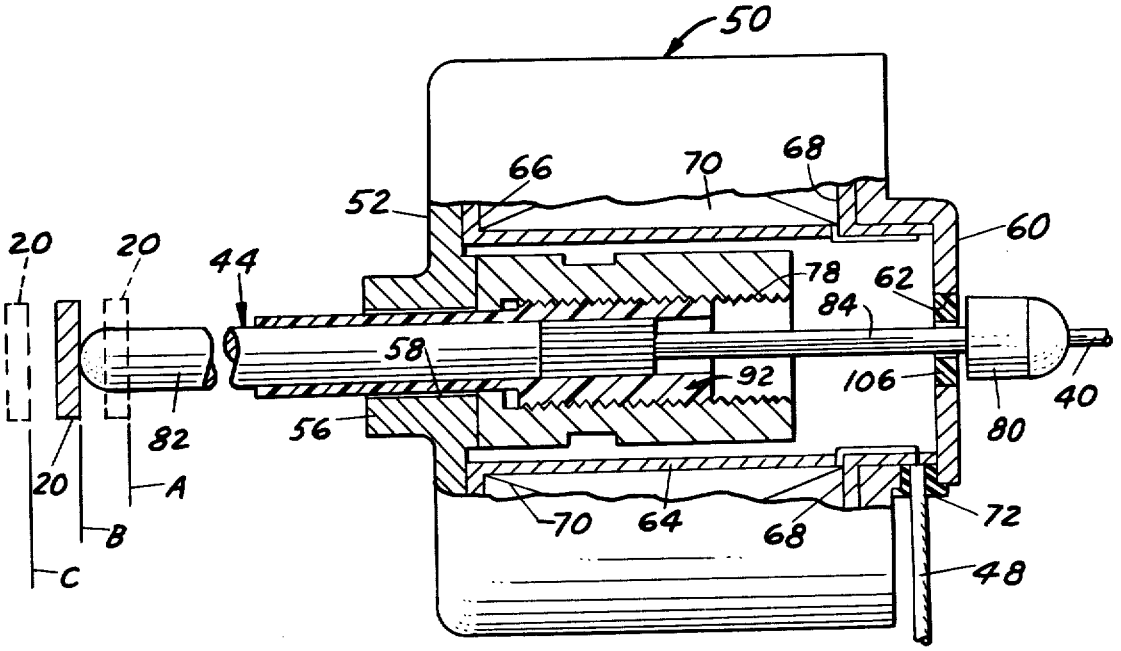
FIG. 2 is an enlarged cross-sectional view of the solenoid actuated device shown in the system of FIG. 1 in an energized position and comprising the present invention.
Figures 3, 4, 5, 6:
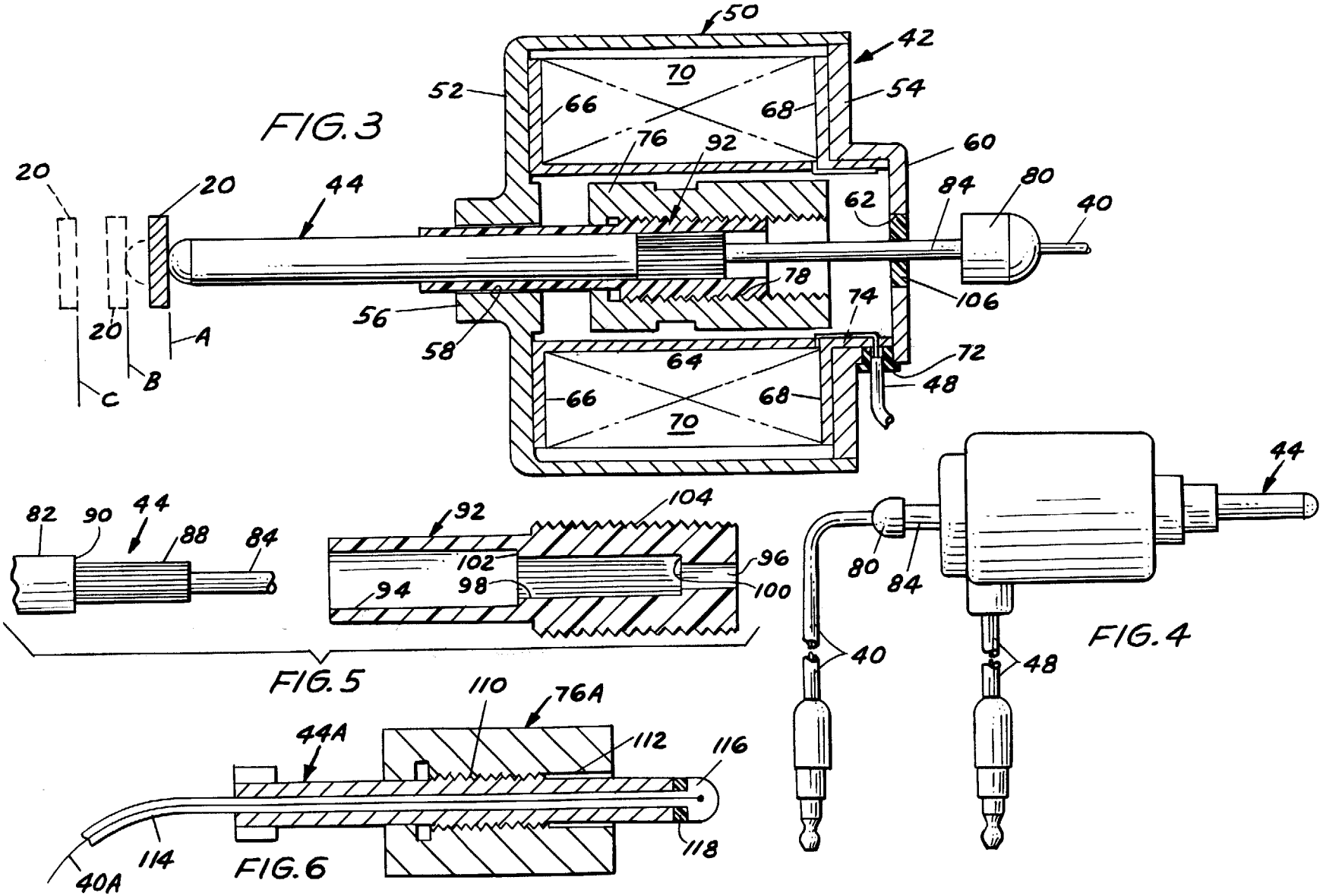
FIG. 3 is a sectional view similar to FIG. 2 but showing the solenoid actuated device of FIG. 2 in a deenergized position.
FIG. 4 is a side elevation view of the solenoid actuated device shown in FIGS. 2 and 3.
FIG. 5 is an exploded partial view of the shaft and insulating sleeve in which the shaft fits shown removed from the armature of the solenoid actuated device.
FIG. 6 is a sectional view of another embodiment of this invention in which an insulated lead wire is mounted within a shaft which is threaded onto the armature.

Mounted within the opening formed by core 64 is an armature generally indicated 76 and moveable between an energized position as shown in FIG. 2 and a deenergized position as shown in FIG. 3. Armature 76 has a central bore 78 with internal screw threads thereon. Shaft 44 has one end thereof adapted to contact throttle arm 20 and its other end has a knob or head 80 which in connected to electrical line 40 to solenoid 36. As shown particularly in FIG. 5, shaft 44 has a large diameter end portion 82, a small diameter end portion 84, and an intermediate diameter connecting portion 86 having splines thereon. Annular shoulders 88 and 90 are formed at the juncture of connecting portion 86 with end portions 82 and 84.

Insulating sleeve generally indicated at 92 is positioned between shaft 44 and armature 76 and has portions thereon to receive mating portions on shaft 44. Insulating sleeve 92 has a central bore including a large diameter end portion 94, a small diameter end portion 96, and a connecting intermediate diameter portion 98. Shoulders 100 and 102 are formed at the junctures of intermediate diameter portion 98 with respective end portions 96 and 94. Intermediate portion 98 has splines therein and shaft 44 may be pressed within sleeve 92 with shoulders 88 and 90 abutting shoulders 100 and 102 in which position shaft 44 is fixed to and moves with sleeve 92. A portion of the outer circumference of sleeve 92 has external screw threads 104 which tightly engage internal screw threads 78 in the bore of armature 76. Shaft 44 and sleeve 92 may be adjusted longitudinally relative to armature 76 by manual gripping of opposite ends of shaft 44 and rotation of sleeve 92 relative to armature 78. Throttle lever 20 is shown in the deenergized position of armature 76 with the engine deactivated at position A in FIGS. 2 and 3. Position B shows the position of throttle arm 20 in the energized position of armature 76 at a curb idle position. Position C shows the position of throttle arm 20 upon acceleration of throttle valve 16 and movement of throttle valve 16 to an open position in which position throttle arm 20 is spaced from shaft 44 moves out of contact therewith. Referring to FIG. 3, in which armature 76 is shown deenergized with the ignition deactivated, shaft 44 is in contact with throttle arm 20 in a retracted position. Shaft 44 may be adjusted to manually determine the spacing between positions A ans B which permits closing of throttle valve 16 below curb idle position upon deactivation of the engine. Position B shows the curb idle position while position A indicates the position upon engine deactivation.

In operation, upon start up or activation of internal combustion engine by ignition 46, device 50 is energized and shaft 44 moves from the position of FIG. 3, to the position of FIG. 2. In this position, while shaft 44 is in contact with throttle arm 20, arm 20 acts to ground the circuit from energy source 38 thereby to energize solenoid 36 for opening valve 34 and bleeding vacuum line 24 to retard the spark as the vacuum from the intake manifold had no effect on diaphragm operated valve 26. However, upon acceleration from a curb idle position, arm 20 moves out of contact with shaft 44 to deenergize solenoid 36 and thereby move valve 34 to a closed position. In this position, the vacuum is exerted from the intake manifold of the engine through vacuum line 24 to diaphragm actuated valve 26 and the spark is advanced dependent upon the vacuum exerted through vacuum line 24 from the intake manifold. Upon deceleration and contact of arm 20 by shaft 44, solenoid 36 is again energized to open valve 34 to bleed vacuum line 24 and retard the spark. Upon shutting off of the engine, armature 76 moves to the position shown in FIG. 3 and throttle valve 16 moves past its idle position to prevent any after run of the engine.

Referring to FIG. 6, a separate embodiment of the invention is shown in which a shaft 44A has external screw threads 110 which are threaded within a threaded central bore 112 of armature 76A. An electrical lead line 40A is covered with rubber insulation 114 and has an outer end conductor 116 which is adapted to contact throttle arm 20. An insulating material 118 insulates end conductor 116 from the remainder of shaft 44A and thereby prevents electrical lead line 40A from being grounded by shaft 44A and armature 76A. It is apparent that other arrangements may be provided to insulate lead line 40A from the solenoid actuated device and thereby permit lead line 40A to be grounded only upon contact with arm 20.

We claim:

1. A solenoid actuated device in combination with an internal combustion engine having a carburetor with a throttle valve therein, and an ignition system for the engine electrically connected to the device, said device controlling the curb idle position of the said throttle valve and permitting the throttle valve to close below the curb idle setting upon deactivation of the ignition system, and comprising:

a shaft mounted within a central bore in said solenoid actuated device for longitudinal movement between an extended energized position of the solenoid device and a retracted deenergized position of the solenoid device, linkage means between the throttle valve and the shaft, said linkage means being out of electrical contact with the shaft when the trottle valve is opened above the curb idle setting and being in electrical contact with an end of the shaft when the trottle valve is at curb idle position and below curb idle position, said shaft end being electrically insulated from said device and connected to a source of electrical energy for grounding said source when the shaft is in electrical contact with the linkage means thereby to permit the energizing of other selective electrically actuated devices.

2. A solenoid actuated device as set forth in claim 1 wherein said device includes an outer housing having a winding therein electrically connected to said ignition system, an armature mounted for movement between energized and deenergized positions and having a central bore therethrough, said shaft being mounted within said central bore for longitudinal movemment with the armature.

3. A solenoid actuated device as set forth in claim 2 wherein said shaft is an electrical conduit, and an electrically insulating member is positioned between the shaft and said armature to provide an electrical grounding of said shaft only when said shaft is in electrical contact with said linkage means.

4. A solenoid actuated device as set forth in claim 2 wherein said shaft has an electrical contact adjacent said one end, and an electrically insulated lead line is carried by said shaft and electrically connected to said electrical contact and to said source of electrical energy for grounding said source only when one end is in contact with the linkage means.

5. A solenoid actuated device in combination with an internal combustion engine having a carburetor with a throttle valve and a throttle arm thereon, and an ignition system for the engine electrically connected to the device, said device controlling the curb idle position of the throttle valve and permitting the throttle valve to close below the curb idle position upon deactivation of the ignition system, and comprising:

an outer housing having a winding therein electrically connected to said ignition system, an armature mounted for movement between energized and deenergized positions and having a central bore therethrough, a shaft mounted within said central bore for longitudinal movement with the armature and having one extending end in electrical contact with the throttle arm when the throttle valve is at curb idle position and below curb idle position, and being out of electrical contact with said arm when the throttle valve is opened above the curb idle position, said shaft being extended in the energized position of said armature to move the throttle arm to the curb idle position and being retracted in the deenergized position of the armature to move the throttle arm below the curb idle position, said one end of the shaft being electrically insulated from said armature and housing and connected to a source of electrical energy for grounding said source when the shaft is in electrical contact with the throttle arm thereby to permit the energizing of other selective electrically actuated devices.

6. A solenoid actuated device as set forth in claim 5 wherein said shaft is an electrical conductor, and an insulated sleeve is positioned between the shaft and the armature to permit a electrical grounding of said shaft only when said extending end of the shaft is in contact with said throttle arm.

7. A solenoid actuated device as set forth in claim 5 wherein said shaft has an electrical contact at said extending end, and an electrically insulated lead line is carried by said shaft and electrically connected to said electrical contact and to said source of electrical energy for grounding of said source only when said one extending end is in contact with the throttle arm.

8. A solenoid actuated device as set forth in claim 5 wherein said shaft is an electrical conductor, and an insulating sleeve is positioned within the armature bore between the shaft and the armature, said sleeve having external screw threads and said armature bore having internal screw threads in engagement with the external screw threads whereby said sleeve may be adjusted longitudinally relative to said armature, said shaft being fixed within said sleeve for movement therewith and thereby controlling the curb idle position and below curb idle position of the throttle valve.

9. The solenoid actuated device as set forth in claim 8 wherein said sleeve has a central bore including a large diameter end portion and a small diameter end portion, said shaft having a large diameter mating end portion fitting within the large diameter bore portion and a small diameter mating portion fitting within the small diameter bore portion.

* * * * *